US006071066A

United States Patent [19]

Braud

[11] Patent Number: 6,071,066

[45] Date of Patent: Jun. 6, 2000

[54] BACKHOE ELEVATOR WITH TELESCOPIC ARM

[75] Inventor: Marcel-Claude Braud, Champtoceaux, France

[73] Assignee: Manitou BF, Ancenis, France

[21] Appl. No.: 09/014,573

[22] Filed: Jan. 28, 1998

[30] Foreign Application Priority Data

Jan. 28, 1997 [FR] France ..... PCT/FR97/00161

[51] Int. Cl.[7] ..... B66F 9/00

[52] U.S. Cl. ..... 414/686; 180/53.4; 180/297; 180/330; 414/680

[58] Field of Search ..... 414/680, 685, 414/694, 686; 180/326, 330, 89.12, 89.13, 291, 53.4, 297; 280/781, 786

[56] References Cited

U.S. PATENT DOCUMENTS

| | | | |
|---|---|---|---|
| 2,228,732 | 1/1941 | Rabe | 280/786 |
| 2,245,789 | 6/1941 | Klavik | 280/786 |
| 3,779,608 | 12/1973 | Hatcher et al. | 180/53.4 X |
| 5,618,156 | 4/1997 | Brown | 414/680 X |
| 5,836,733 | 11/1998 | Moses et al. | 414/685 |

*Primary Examiner*—Donald W. Underwood
*Attorney, Agent, or Firm*—Young & Thompson

[57] ABSTRACT

A backhoe elevator includes a front, loading arm supported on a frame forward of a driver cab midway between front and rear axles. The frame includes two spaced apart elongated members that define a space for retraction of the arm between the members. The controls for the loading arm are disposed along a central axis of the backhoe elevator. The engine is transversely mounted and includes two outputs, one for a hydraulic pump and one for a gear box that is below the support for the loading arm between the frame members. The support for the loading arm may include two parallel plates, one of which is a vertical extension of one of the elongated members and the other of which is mounted on an upper plate that is between and perpendicular to the elongated members. One of the elongated members may have a rear portion that is curved outwardly so that it is not parallel to the other of the elongated members.

7 Claims, 5 Drawing Sheets

BACKHOE ELEVATOR WITH TELESCOPIC ARM

BACKGROUND OF THE INVENTION

The invention relates to automotive vehicles provided at the front with a telescopic arm carrying a loading bucket and at the rear with an excavating shovel, generally known as backhoe elevators or shovel loaders.

French patent 2.696.199 in the name of MANITOU BF discloses a backhoe elevator with a central telescopic arm, in which the front driver station of the telescopic arm as well as the rear driver station for the excavating shovel are located within a cab having an L-shaped configuration. When the operator is in the front driver station, he is seated on his seat disposed laterally between the front wheel and the rear wheel on one side of the backhoe elevator, such that the telescopic arm constitutes an obstacle to lateral visibility of the operator on the side opposite the cab relative to the telescopic arm.

Moreover, because of the L-shape of the cab, the exit from the cab from the front driver station can take place only from the side opposite the telescopic arm and the exit from the cab from the rear driver station can take place only after having moved the seat to the rear position and having turned the latter an additional quarter turn.

As a result, this known backhoe elevator has on the one hand the drawback of poor visibility laterally and forwardly in the loading position, the telescopic arm interfering with the view of the driver on the side opposite that of the cab, and on the other hand, is costly to produce by reason of the high cost of production of the cab.

SUMMARY OF THE INVENTION

The first object of the invention is to overcome these drawbacks by providing a new backhoe elevator which is simple in construction and economical, comprising a cab of reduced dimensions, with entry and exit on each side from the front driver station.

A second object of the invention is to ensure to the driver maximum visibility of the tools both forwardly and rearwardly and to the sides. This requirement of optimum visibility is important both for precision of work as well as safety of movement.

A third object of the invention is to permit easy and rapid passage from one driver station to the other to ensure reliable and ergonomic operation.

The invention has for its object an automotive backhoe elevator with a telescopic loading arm and an excavating shovel, of the type comprising a rigid frame carried by two front and rear bridges provided with wheels; a driver cab containing a front drive console and a rear handling console disposed along the medial longitudinal axis of the machine; in which the articulation support of the loading arm is disposed in front of the cab substantially toward the middle of the distance between the front and rear axles, characterized in that the frame is a beamshaped frame comprising two elongated members spaced from each other and defining in front of the support a space for receiving the arm in the lowered position, and in that the motor is disposed transversely in a compartment fixed externally to an elongated member of the frame between a front wheel and a rear wheel.

According to other characteristics of the invention:

the transversely oriented motor is connected to an angled transmission with two outputs driving by one output at least one hydraulic pump and by its other output a gear box disposed substantially in the center of the machine, substantially below the support of the telescopic arm and between the two elongated members of the frame, the compartment containing the transversely oriented motor contains also a radiator cooled by a fan, a pivoting seat is disposed between the front console and the rear console, the articulation support of the loading arm disposed in front of the cab comprises two parallel plates of which the spacing is less than that of the elongated members, the arm support comprises two plates of which one is disposed in the same vertical plane as one of the elongated members in the direction of the longitudinal medial axis of the machine and said second plate is connected to said second elongated member by a force return plate disposed outwardly, the frame carries laterally between the front and rear wheels on one side the motor and on the other side the on-board fluid reservoirs, the axis of articulation of the loading arm on the support is disposed in height below the upper edge of the front drive console, the frame carries laterally between the front and rear wheels on one side the motor and on the other the on-board fluid reservoirs, and at least one elongated member is, toward the rear, curved outwardly, so as to support conjointly with the other elongated member a rear structure comprising a rear excavating shovel carriage, the axis of articulation of the arm on the support is disposed in height below the upper edge of the front drive console and the upper portion of the front console is of a width substantially equal to or less than that of the support of the loading arm.

BRIEF DESCRIPTION OF THE DRAWINGS

The invention will be better understood from the description which follows, given by way of non-limiting example, with reference to the accompanying drawings, in which.

DESCRIPTION OF THE PREFERRED EMBODIMENTS

Figure 1:
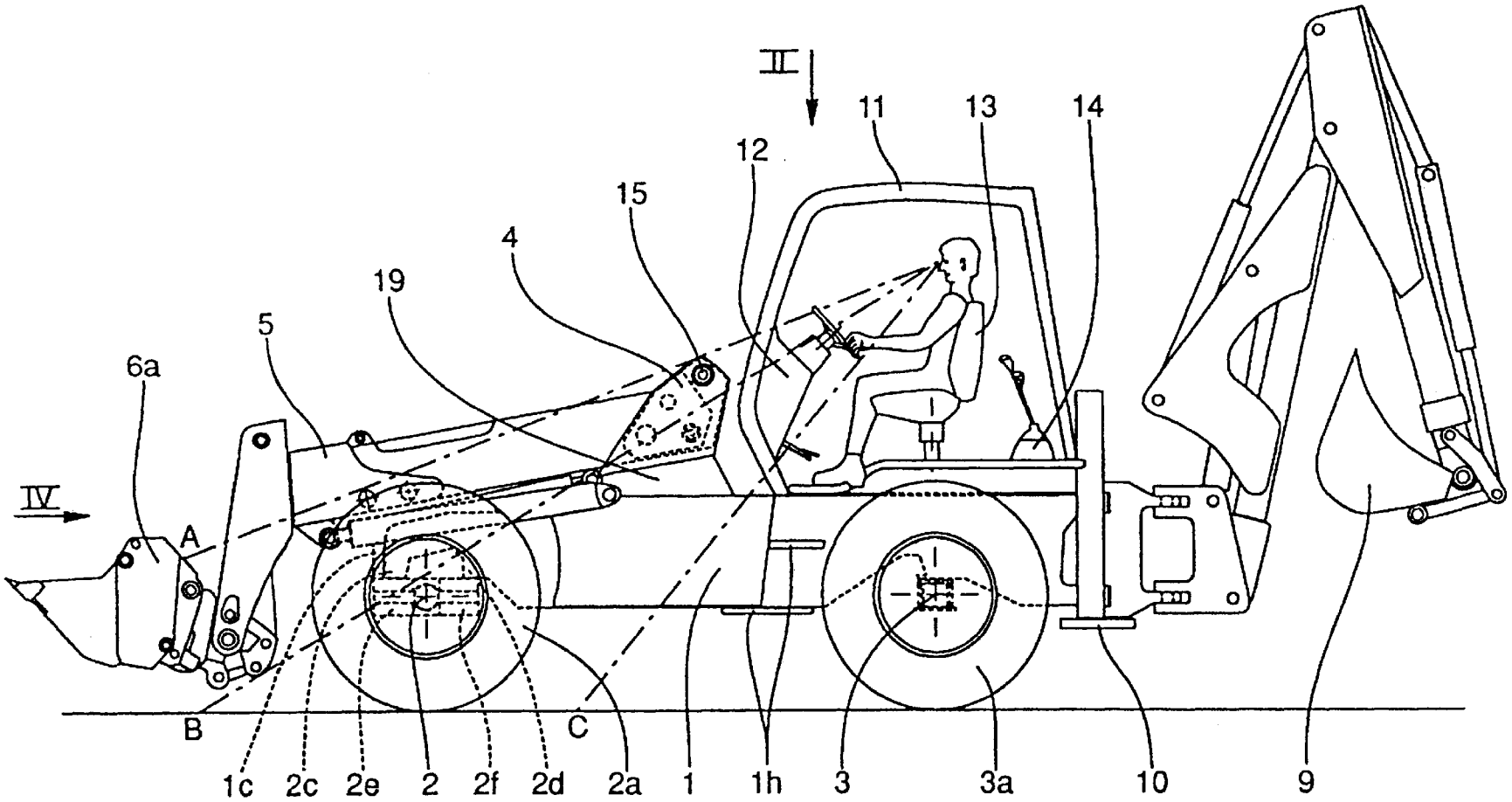
FIG. 1 shows schematically a side elevational view of a backhoe elevator according to the invention, controlled from the front console.
Figure 2:
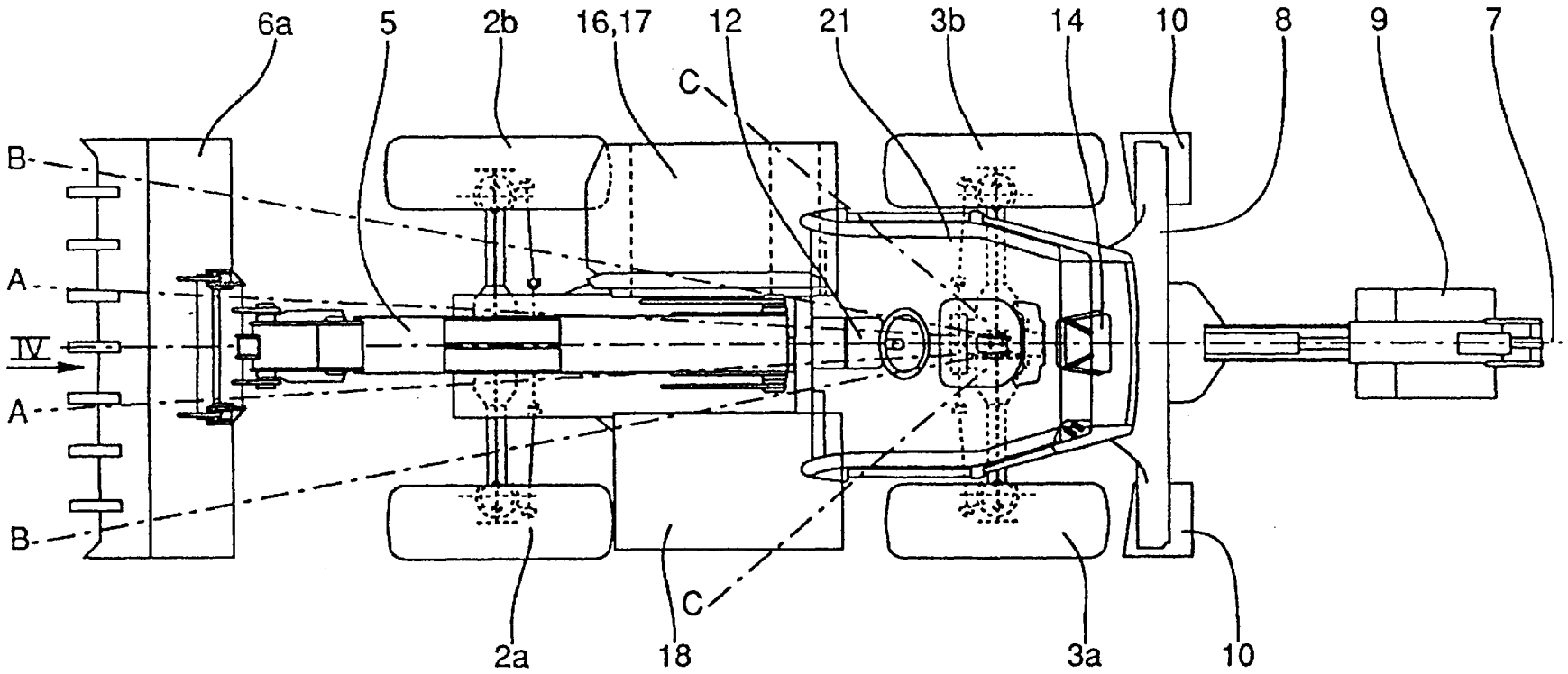
FIG. 2 shows schematically in plan view in the direction of arrow II in FIG. 1, a backhoe elevator according to the invention.

With reference to FIGS. 1 to 4, a backhoe elevator according to the invention comprises a beamshaped frame 1 carried by a front bridge 2 and a rear bridge 3. The front bridge 2 is an oscillating bridge with an autoblocking differential with limited sliding, for driving and orienting two front driven and steering wheels 2*a*, 2*b* carried by front axle 2*g*. The oscillating of the front bridge is limited by two oscillation abutments constituted by protrusions on the frame 1.

The rear bridge 3 is a non-oscillating bridge with an autoblocking differential with limited sliding, for the driving and orientation of the two driven and steering rear wheels 3*a*, 3*b* carried by rear axle 3*c*.

The rear bridge 3 is fixed to the frame 1, provided for this purpose with two right and left support plates adapted to receive each four tie rods connected to a securement plate.

The beamshaped frame 1 is a frame comprising two elongated members 1*a*, 1*b* that are substantially parallel and spaced from each other with a spacing greater than the width of a telescopic arm 5 articulated on a support 4 comprising two parallel plates 4*a*, 4*b* whose spacing is less than that of the elongated members 1*a*, 1*b*.

The elongated members 1*a*, 1*b* comprising metal plates of substantial thickness are interconnected in the front by a front plate 1*c* cut out to receive in lowered position the telescopic arm 5 carrying a tool 6 such as a bucket 6*a* (FIG. 1) or forks 6*b* (FIG. 5) and by two plates 2*c*, 2*d* for supporting bearings 2*e*, 2*f* for oscillation of the front bridge 2.

A configuration for reception of the telescopic arm 5, oriented along the medial longitudinal axis 7 of the backhoe elevator, also connects the two elongated members 1*a*, 1*b* in front of the support 4.

The plate 4*b* of the support 4 is preferably constituted by a prolongation of the elongated member 1*a*, whilst the plate 4*a* of the support 4 is welded simultaneously to a force-absorbing plate 19 and to an upper plate 19*a* for interconnecting the elongated members 1*a* and 1*b*. This plate 19*a* also carries the supports for the axle of articulation of the lifting jack for the telescopic arm 5.

The frame 1 accordingly comprises a front portion and a rear portion of substantially equal length: the support 4 of the telescopic arm is located at the end of the front portion, whilst the elongated member 1*a* is curved outwardly and rearwardly from the front portion, so as to support conjointly with the elongated member 1*b* a rear structure comprising a carriage 8 on which is mounted the rear shovel 9.

This rear transverse structure also carries two retractable stabilizers 10 on opposite sides of the carriage 8.

A drive station is mounted on the chassis 1, on four shock absorbing supports disposed at positions 1*d* to 1*g*, outside the elongated members 1*a*, 1*b*.

The drive station is constituted by an assembly comprising a cab 11 containing all the drive equipment for the backhoe elevator.

The cab 11 contains a front drive console 12, a pivoting seat 13 and a rear console 14 for manipulating the rear shovel 9, mounted substantially on the longitudinal axis 7 of the backhoe elevator.

The interior of the cab 11 is accessible from the two sides by means of left and right steps lh located before the right and left rear wheels 3*a* and 3*b*, respectively.

The cab 11 also contains, substantially along the axis of the right rear wheel 3*b* and behind the corresponding exit, a lateral control console 21 for the telescopic arm 5 and for operation of the corresponding tool 6 (6*a*, 6*b*) carried by the telescopic arm.

The front console 12 contains the various control means necessary to drive the backhoe elevator: this front console comprises particularly the drive column, the steering wheel, the handles and levers used to drive the machine, the different dials and gauges, the pedals.

The front console 12 is of a width most equal to that of the support 4 and the articulation axle 15 of the arm 5 on the support 4 is disposed as to height below the upper edge of the console 12.

The rear console 14 carries levers for manipulating the shovel 9, as well as preferably also the control of stabilizers 10, the control of the lateral displacement of the shovel 9 and if desired a manual control of the motor function.

The spacing between the console 12 and the rear console 14 is provided such that the rotation of the seat 13 naturally brings the driver into his working position in the two stations.

The upper portion of the front console 12 is of a width substantially equal to or less than that of the support 4 for the loading arm 5, and this support 4 extends heightwise so as to be located at a level below that of the upper edge of said front console 12.

Figure 5:
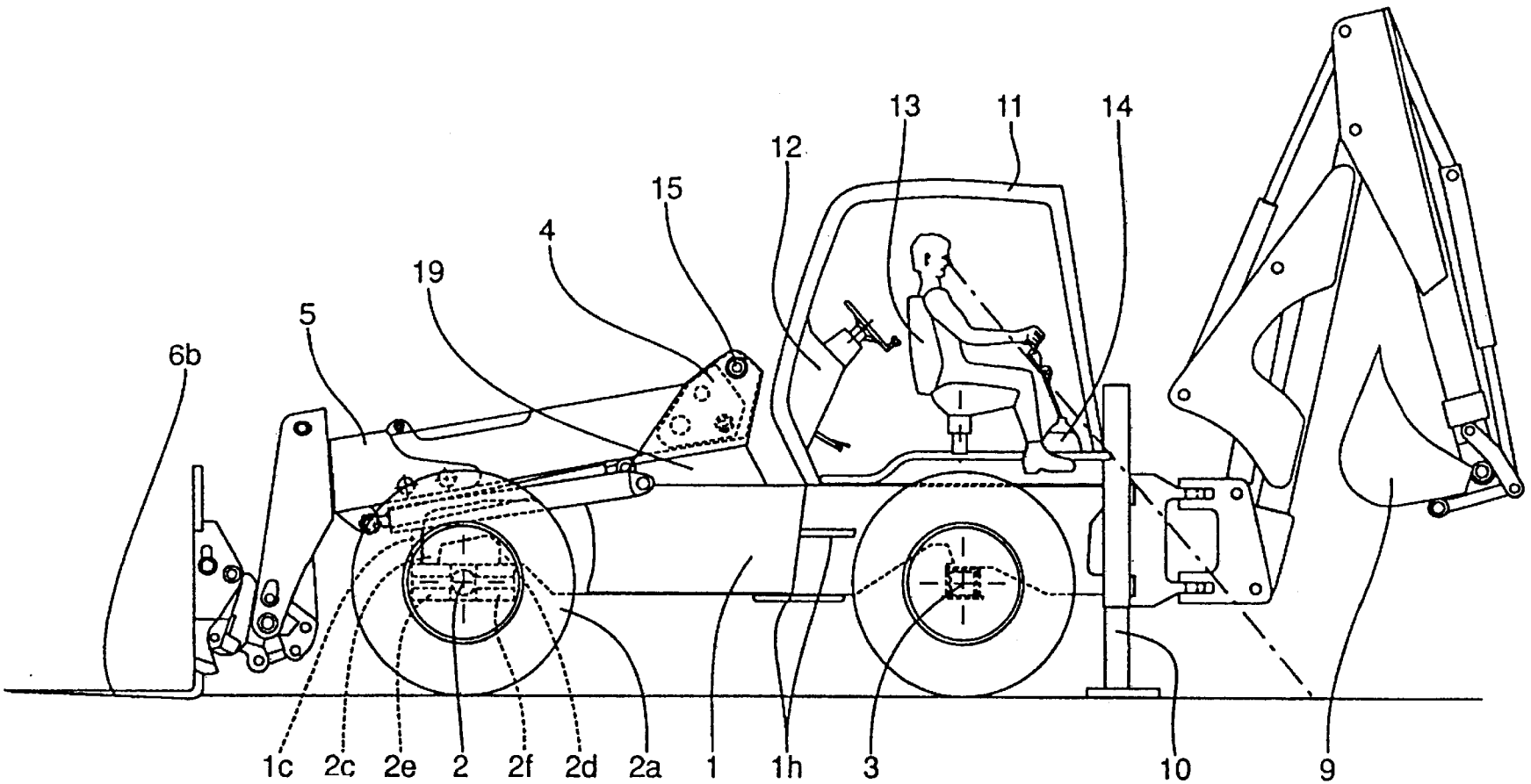
FIG. 5 shows schematically a side elevational view of a backhoe elevator according to the invention, controlled from the rear console.

The rear console 14 is disposed behind and above the rear bridge 3 in a position corresponding to direct visibility over a working zone which is nearest the rear shovel (FIG. 5).

Thanks to the arrangements of the invention, particularly thanks to the fact that the front console 12 is of a width at most equal to that of the support 4 and that the articulation axle 15 of the arm 5 on the support. 4 is disposed in height below the upper edge of the console 12, the visibility over all the angles is optimum, particularly as to the front tool 6 carried by the telescopic arm 5, as shown in the figures in which there are reproduced by the broken lines A, B, C the lines of sight of the driver seated in the cab.

For economical production and for easy and rapid emplacement of the cab, there are preferably provided electrical, electrohydraulic or mechanical control means adapted to be coupled or uncoupled rapidly from the connections to the power or actuation distribution means.

Figure 3:
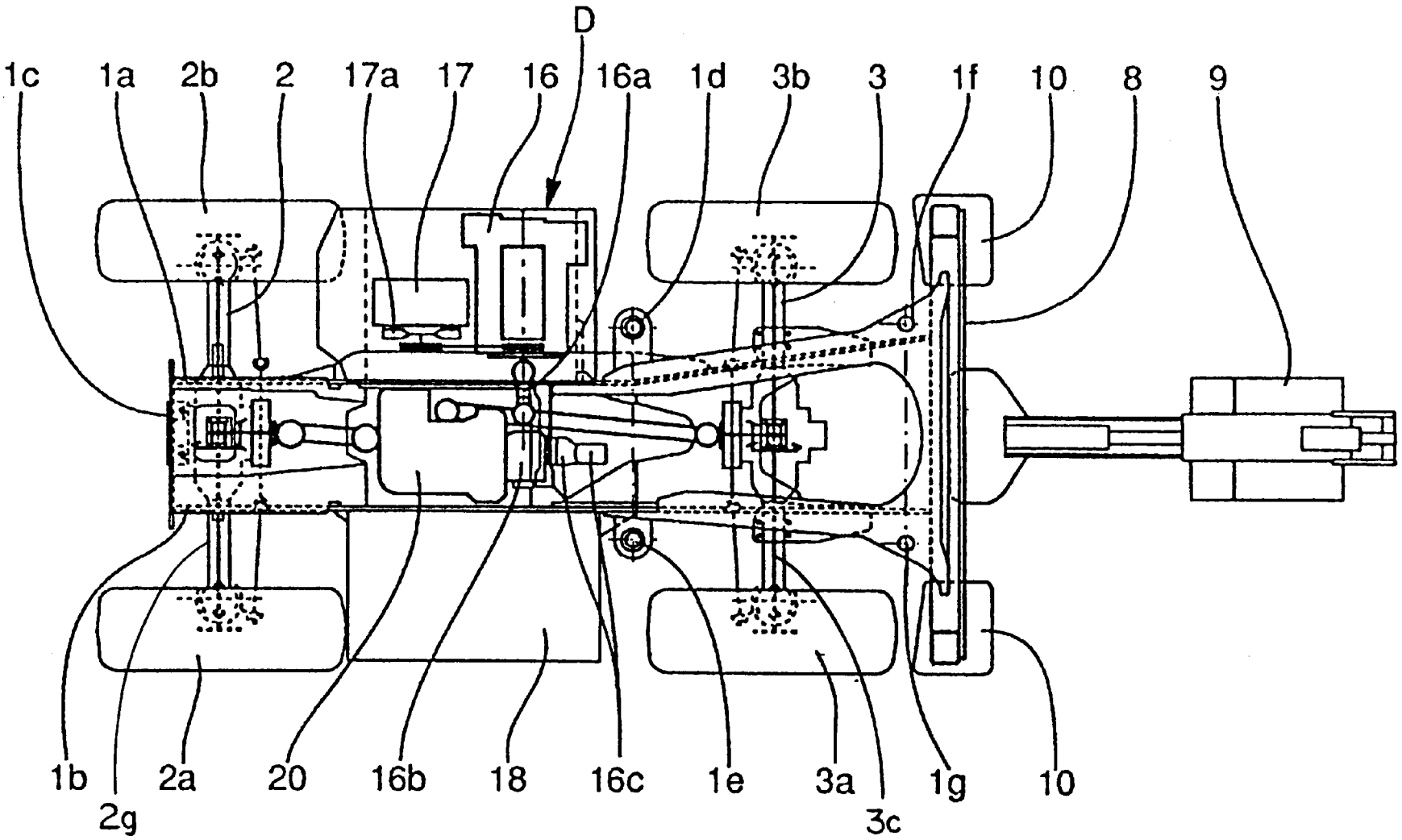
FIG. 3 shows schematically a plan view analogous to FIG. 2 of a backhoe elevator according to the invention, in which the cab and the telescopic arm have been omitted to show the relative arrangement of the principal mechanical members of the backhoe elevator.
Figure 4:
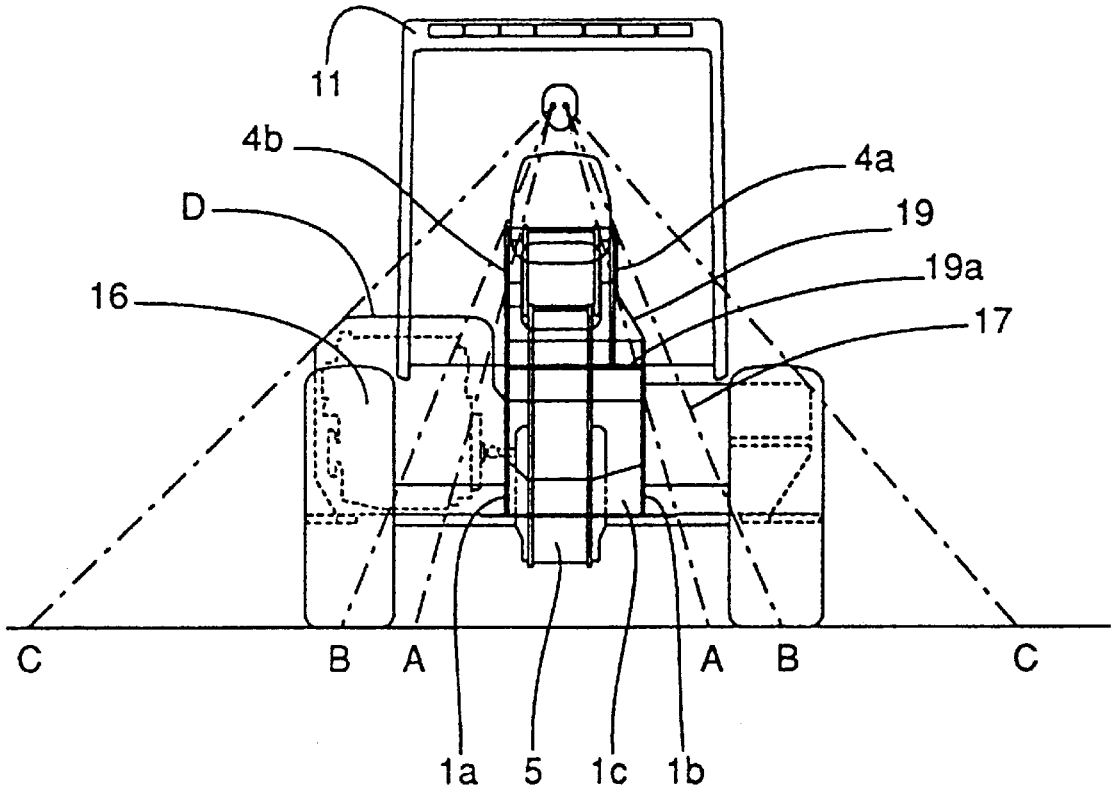
FIG. 4 shows schematically a front elevational view in the direction of arrow IV of FIGS. 1 and 2 of a backhoe elevator according to the invention.

In FIG. 3, a compartment D containing a diesel motor 16, oriented transversely, and a radiator 17, whose fan 17*a* is driven by a belt passing over two pulleys of which one is driven by the flywheel of the motor, is attached and fixed externally by screwing to the elongated member 1*a* in the free space between the front wheel 2*b* and the rear wheel 3*b*. The reservoirs 18 for the various on-board fluids (fuel for the motor, hydraulic fluid, if desired oil for a transmission) are fixed in an analogous manner to the supports of the elongated member 1*b*, in the free space between the front wheel 2*a* and the rear wheel 3*a*.

A shaft with a universal joint 16*a* mounted at one end on the flywheel of the transversely oriented diesel motor 16 is coupled at the other end to bevel gearing 16*b*.

This bevel gearing 16*b*, preferably with a transverse shaft, drives by one output hydraulic pumps 16*c* and by another output a gear box 20.

The hydraulic pumps 16*c* supply hydraulic energy to the actuators (jacks or hydraulic motors) of the backhoe elevator by means of distributors controlled from control consoles 12, 14 and 21. The use and emplacement of these actuators and distributors (not shown, for purposes of clarity) are well known to those in the art and do not require a more detailed description.

The gear box 20 is disposed substantially at the center of the machine between the two elongated members 2*a* and 2*b*, in the forward portion of the chassis 1 and substantially below the support 4 of the telescopic arm 5. It drives the front and rear axles 2*g* and 3*c* by means of corresponding shafts with universal joints.

This particular arrangement of the location of the gear box 20 practically at the center of the machine, below the support 4 of the arm 5, gives better centering of the masses and permits limiting the width of the chassis to a value near that of the gear box 20, and to the space strictly necessary for the reception of the telescopic arm 5 in lowered position between the elongated members 1*a* and 1*b*.

The limitation of the width of the chassis 1, corresponding to the spacing of the elongated members 1*a*, 1*b* between the forward bridge 2 and the rear bridge 3, has a favorable influence on the turning radius and hence on the maneuverability of the machine.

The particular arrangement of the motor 16 and the gear box 20 thus permits designing a machine with a short and narrow chassis, which is very favorable for the forward visibility and further improves the maneuverability.

The modular conception of the assembly forming the cab, a motor-propulsion group in which the transverse position of the motor gives optimal accessibility for adjustment and maintenance without disassembly, of an assembly of reservoirs 18 on the chassis 1, permits economical production and easy maintenance, as well as ergonomic use of the backhoe elevator according to the invention.

The invention is not limited to the embodiments described; it covers on the contrary any modification of shape or variation of embodiment within the scope and spirit of the invention: thus, the mechanical transmission between the motor and the gear box can take place without using a universal shaft, by means of an elongated connection connecting the motor shaft to the bevel gearing with the use if desired of a fluted shaft engaged slidably in a fluted drive sleeve.

What is claimed is:

1. An automatic backhoe elevator comprising:

a rigid frame comprising two elongated members, said frame being carried by two front and rear bridges provided with front and rear axles carrying respective front and rear wheels;

a rear excavation shovel that is attached to a rear of said frame;

a driver cab on said frame and containing a front driving console and a rear manipulating console disposed along a medial longitudinal axis of the backhoe elevator;

a telescopic loading arm and a support for articulation of the loading arm that is disposed forward of the cab substantially midway between the front axle and the rear axle; and a motor disposed transversely in a compartment fixed externally to one said elongated member of the chassis between one of the front wheels and one of the rear wheels;

the two elongated members being spaced from each other and defining forwardly of the support a space for receiving the arm in a lowered position;

wherein the support comprises two parallel plates, one of said plates being a vertical extension of one of said elongated members in the same vertical plane as said one of the elongated members, and a second of said plates being connected to an upper plate that is between and perpendicular to said elongated members, and wherein the motor is connected to a beveled gear transmission with two outputs driving by one of said outputs at least one hydraulic pump and by its other one of said outputs a gear box disposed substantially along the medial longitudinal axis of the machine, substantially below the support of the telescopic arm and between the two elongated members of the chassis.

2. The backhoe elevator of claim 1, wherein the compartment containing the transversely oriented motor also contains a radiator cooled by a fan.

3. The backhoe elevator of claim 1, further comprising a pivotal seat between the front driving console and the rear manipulating console.

4. The backhoe elevator of claim 1, wherein the front driving console has a width at most equal to that of the support and wherein an articulation axle of the arm on the support is disposed heightwise below an upper edge of the front driving console.

5. The backhoe elevator of claim 1, wherein at least one of said elongated members is curved rearwardly outwardly so as to have a rear portion not parallel to the other of said elongated members.

6. An automotive backhoe elevator comprising:

a rigid frame comprising two elongated members, said frame being carried by two front and rear bridges provided with front and rear axles carrying respective front and rear wheels;

a rear excavating shovel that is attached to a rear of said frame;

a driver cab on said frame and containing a front driving console and a rear manipulating console disposed along a medial longitudinal axis of the backhoe elevator;

a telescopic loading arm and a support for articulation of the loading arm that is disposed forward of the cab substantially midway between the front axle and the rear axle; and a motor disposed transversely in a compartment fixed externally to one said elongated member of the chassis between one of the front wheels and one of the rear wheels;

the two elongated members being spaced from each other and defining forwardly of the support a space for receiving the arm in a lowered position; and wherein the support comprises two parallel plates, one of said plates being a vertical extension of one of said elongated members in the same vertical plane as said one of the elongated members, and a second of said plates being connected to an upper plate that is between and perpendicular to said elongated members.

7. The backhoe elevator of claim 6, further comprising a transverse force-absorbing plate connecting said second of said plates to the other of said elongated members.

* * * * *